US007396272B1

(12) United States Patent
Newlen

(10) Patent No.: US 7,396,272 B1
(45) Date of Patent: Jul. 8, 2008

(54) TRANSITIONAL FEMININE STYLED GARMENT FOR MASTECTOMY PATIENTS

(76) Inventor: Kim Newlen, 401 Whitmore Ct., Richmond, VA (US) 23229

( * ) Notice: Subject to any disclaimer, the term of this patent is extended or adjusted under 35 U.S.C. 154(b) by 0 days.

(21) Appl. No.: 11/598,992

(22) Filed: Nov. 14, 2006

Related U.S. Application Data

(63) Continuation-in-part of application No. 10/997,299, filed on Nov. 24, 2004, now abandoned.

(51) Int. Cl.
*A41C 3/00* (2006.01)
*A41C 3/10* (2006.01)

(52) U.S. Cl. ..... 450/54; 450/36; 2/114

(58) Field of Classification Search ..... 450/54–58, 450/37–39, 1; 2/104–106, 102, 69, 67, 267, 2/268; 128/890, 888, 889; 604/385.07; 623/7, 623/8; 602/60, 61
See application file for complete search history.

(56) References Cited

U.S. PATENT DOCUMENTS 1,272,427 A * 7/1918 Haderlein ..... 450/37
2,258,209 A * 10/1941 De Jorio ..... 604/385.07
2,925,816 A * 2/1960 Rosenthal ..... 450/37
3,628,539 A * 12/1971 Fredricks ..... 450/3

OTHER PUBLICATIONS

Gershman,MD;Maurice; Journal of the American Medical Association, vol. 68,No. 7 p. 930.*

* cited by examiner

*Primary Examiner*—Gloria Hale

(57) ABSTRACT

A transitional feminine styled garment for use by mastectomy patients immediately following surgery, the garment being sleeveless and having wireless and non-binding pockets for soft molded cups. The garment has inside drainage pockets for drainage receptacles.

5 Claims, 9 Drawing Sheets

TRANSITIONAL FEMININE STYLED GARMENT FOR MASTECTOMY PATIENTS

This application is a Continuation-In-Part of U.S. patent application Ser. No. 10/997,299 filed Nov. 24, 2004 now abandoned, which is referred to herein and incorporated in its entirety into the present application.

FIELD OF THE INVENTION

This invention relates to a transitional feminine styled garment for mastectomy patients for use immediately following surgery.

BACKGROUND OF THE INVENTION

One of the most traumatic experiences a woman can endure is a mastectomy. There has been a long felt need for apparel for the patient after the surgery and numerous efforts have been made to supply these needs. Examples are garments with outside pockets for the support of drainage receptacles, camisoles with outer pockets having side openings or inside horizontal pockets with open ends for drainage vessels, prostheses inserted in pockets shaped to the normal configuration of the breast and surgical recovery brassieres with drain tube apertures and storage pouches.

SUMMARY OF THE INVENTION

None of the prior art efforts have successfully solved the problem of providing a woman with feminine styled and attractive undergarments or garments for transitional use immediately following surgery. The garment of the present invention is a stylishly designed, easily used garment which can be used as a regular garment or undergarment with soft molded cups and no underwire, plastic, or other bindings, and includes inside pockets for drainage receptacles.

Figure 1:
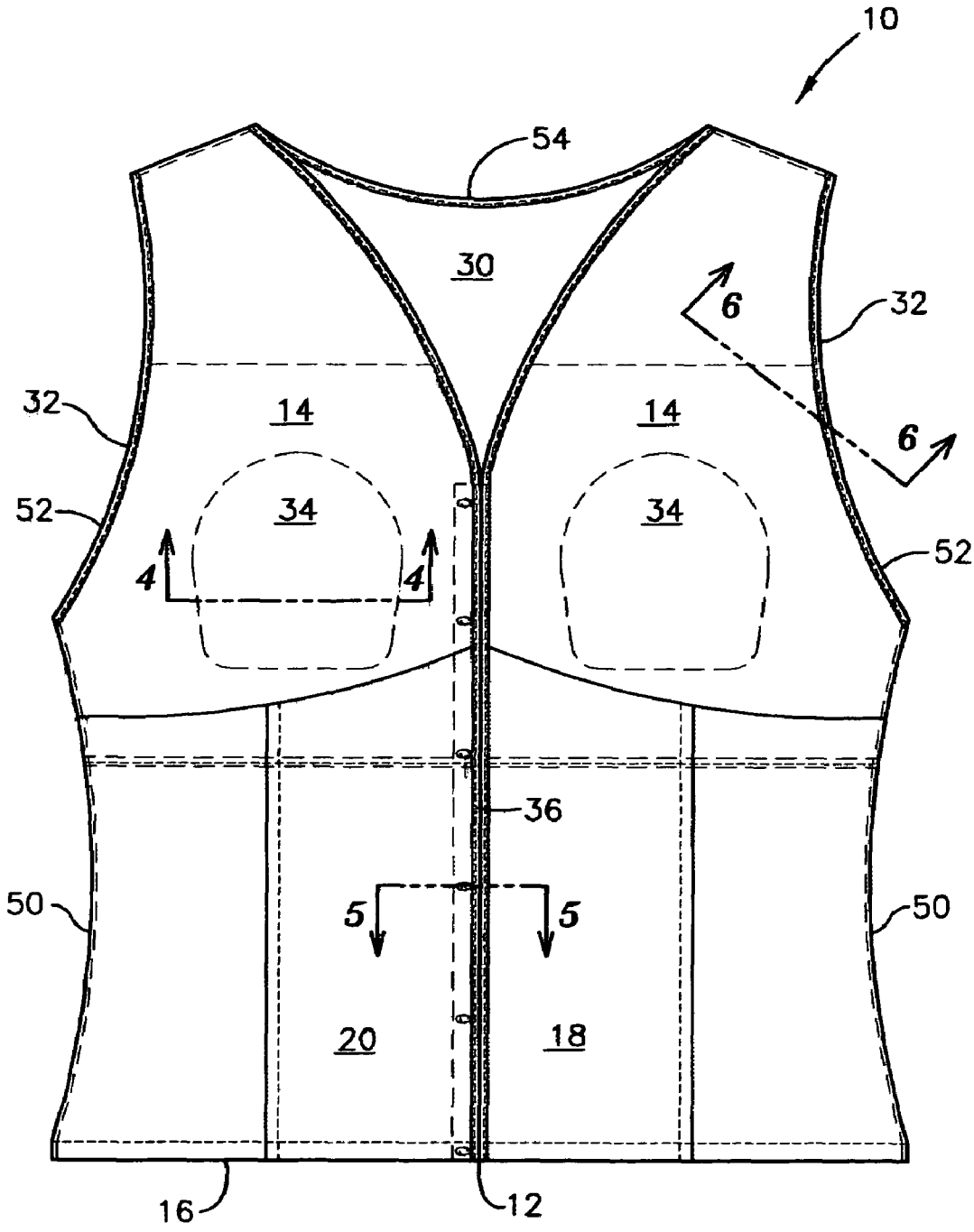
FIG. 1 is a front buttoned view of one embodiment of the garment.

| Part Number | Description |
|---|---|
| 10 | undergarment or garment |
| 12 | front section or garment front panel |
| 14 | fabric |
| 16 | front lower edge |
| 18 | left front section |
| 20 | right front section |
| 22 | rear section or garment rear panel |
| 24 | rear lower edge |
| 26 | shoulder engaging yoke |
| 28 | connector between front section and rear section |
| 30 | neck receiving opening |
| 32 | sleeveless opening |
| 34 | soft cup |
| 36 | front closure |
| 38 | pocket for drainage receptacles located on inside |
| 40 | top opening |
| 42 | pocket bottom edge |
| 44 | soft cup pocket or pocket for soft cups |
| 45 | open top of soft cup pocket |
| 46 | pocket outside surface |
| 47 | closed bottom of soft cup pocket |
| 48 | pocket inside surface |
| 49 | seam |
| 50 | concave side |
| 52 | concave sleeveless opening |
| 54 | concave neck opening |
| 56 | pocket elastic edge at top opening |
| 58 | elastic edge on each side of the closure |
| 60 | elastic edge of neck receiving opening |
| 62 | elastic edge of sleeveless opening |
| 64 | button |
| 66 | button hole |
| 68 | flap on left section |
| 70 | flap on right section |
| 72 | flat exterior |
| 73 | wall of soft cup pocket layer |
| 74 | soft cup pockets or pocket for soft cups on second layer of second side |
| 75 | wall of soft cup pocket layer |
| 76 | first drainage pocket |
| 78 | second drainage pocket |
| 80 | first end |
| 82 | second end |
| 84 | container |
| 86 | drainage tubing |
| 88 | lace |
| 90 | lace edging |
| 92 | horizontal midseam |
| 94 | access opening on first end |
| 96 | access opening on second end |
| 98 | bottom of drainage pocket |
| 100 | first wall |
| 102 | second wall |
| 104 | opening for drainage pocket |
| 106 | bottom of garment |
| 108 | top of soft cup pocket |
| 110 | location of soft cup |
| 112 | midseam separating two soft cup pockets |
| 114 | top of drainage cup pocket |
| 116 | outer or first layer |
| 118 | inside or second layer |
| 120 | inside wall of soft cup pocket of first side fastened to second layer |
| 122 | inside wall of soft cup pocket of second side fastened to second layer |
| 124 | garment |
| 126 | first side or garment front panel |
| 128 | second side or garment rear panel |
| 130 | outer or first layer |
| 132 | inside or second layer |
| 134 | bottom of second layer |
| 136 | yoke |
| 138 | neck-receiving opening |
| 140 | low on first side or low neckline |
| 142 | high on second side or high neckline |
| 144 | arm openings |
| 146 | soft cup pockets or pocket for soft cups on second |

-continued

| Part Number | Description |
|---|---|
| | layer of first side |

DETAILED DESCRIPTION OF THE INVENTION

The garment or camisole of this invention is a transitional piece of lingerie that every woman who has had a mastectomy will need immediately following surgery and for several weeks following her surgery and may be continued to be used thereafter. It is to be noted that undergarment, garment, and lingerie are used interchangeably throughout this application, as the garment may be usable for any of these uses.

A stretchable fabric, as used herein, is a fabric made from a material that stretches, such as spandex. Spandex is a man-made elastic fiber of at least 85% segmented polyethylene. It stretches under tension and recovers its original length when tension is released. It can stretch four to seven times its original length. It may be combined with other yarns to produce stretch. It is well known as Lycra®, which is a brand name owned by DuPont and is available from many sources such as spandexhouse.com found on the Internet. It is lightweight, soft, smooth, and supple.

Also reference is made to "drains", "drainage pockets", "drainage receptacles", and "drainage containers". These are well known to those skilled in the art and U.S. Pat. Nos. 4,341,212 issued Jul. 27, 1982, 6,270,485 issued Aug. 7, 2001, and 6,574,800 issued Jun. 10, 2003 are referred to and incorporated herein in their entirety and made a part of this specification.

Figure 7:
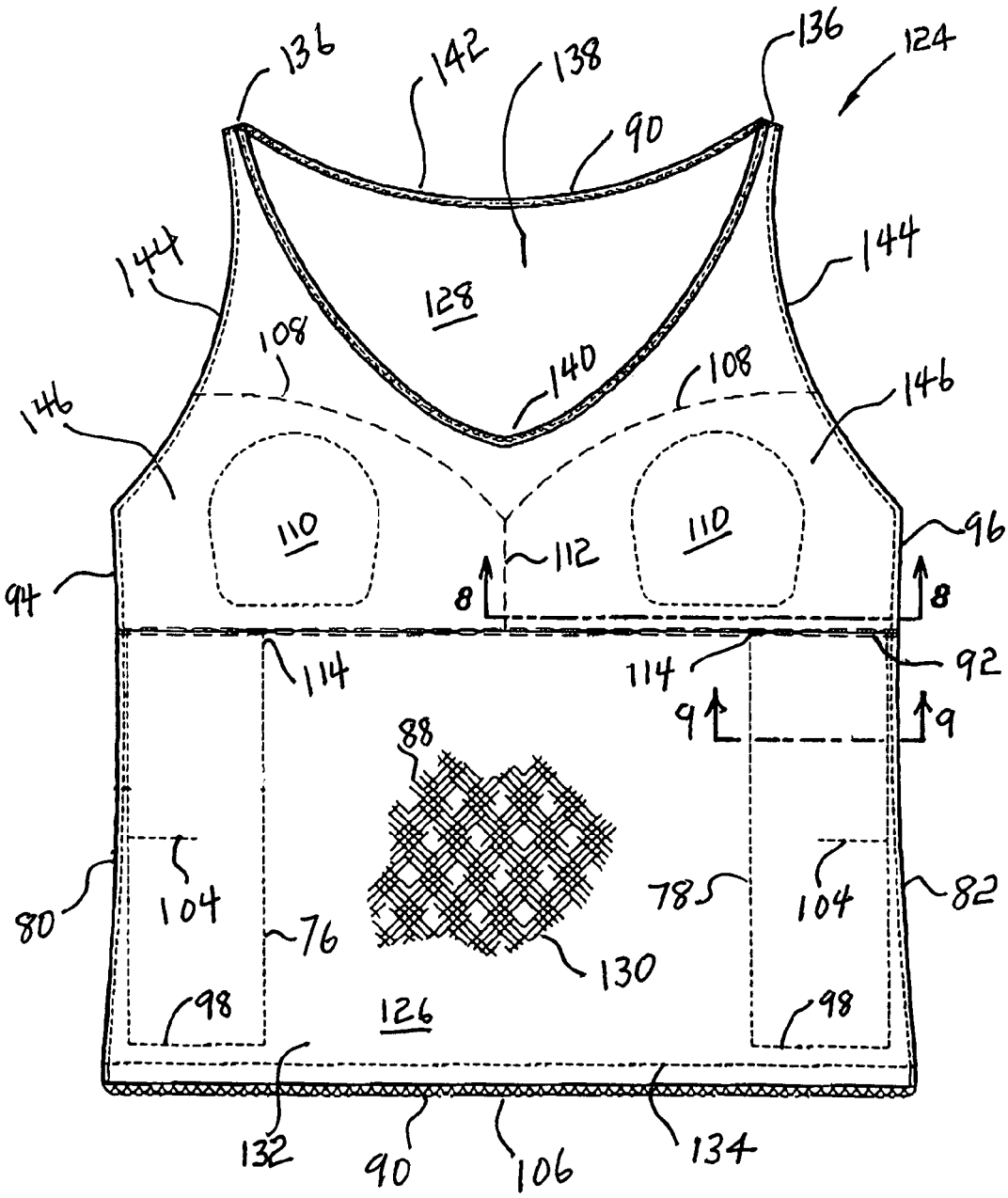
FIG. 7 is a front view of a preferred embodiment.
Figure 8:
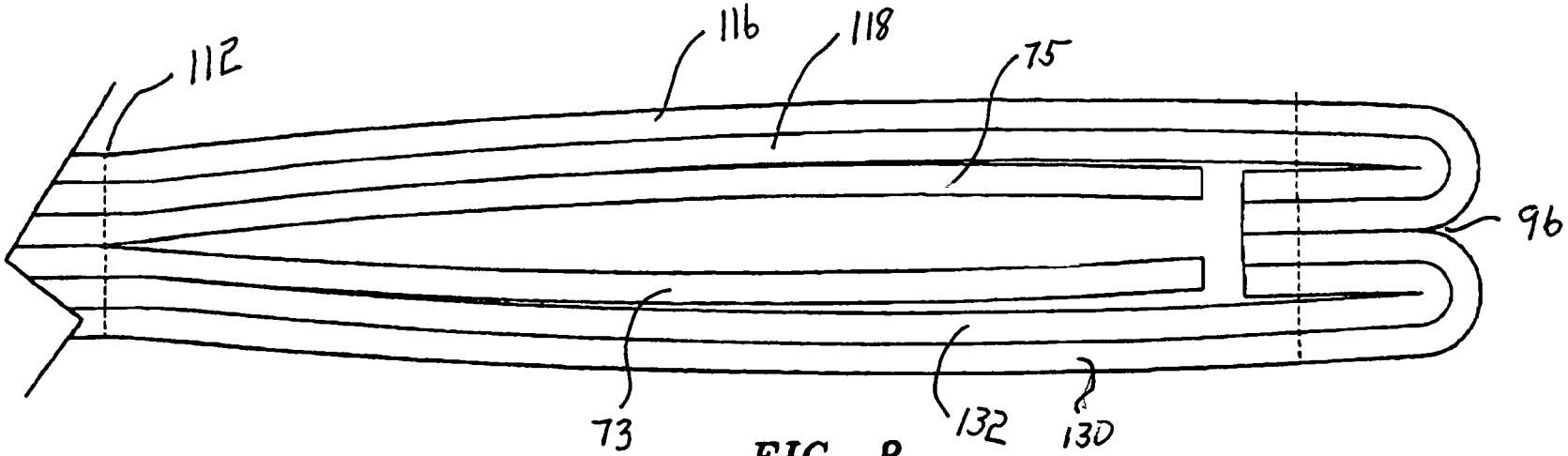
FIG. 8 is a partial sectional view 8-8 through the pocket of FIG. 7.
Figure 9:
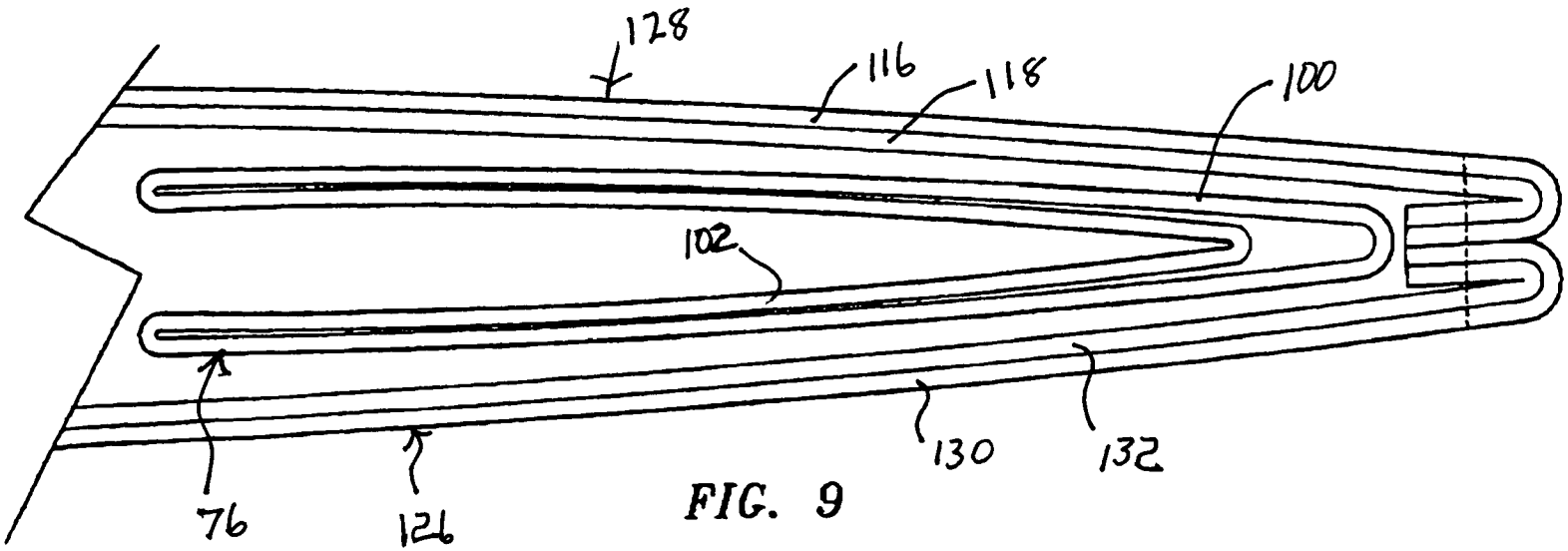
FIG. 9 is a partial sectional view through the pocket for the drainage receptacles of FIG. 7.
Figure 10:
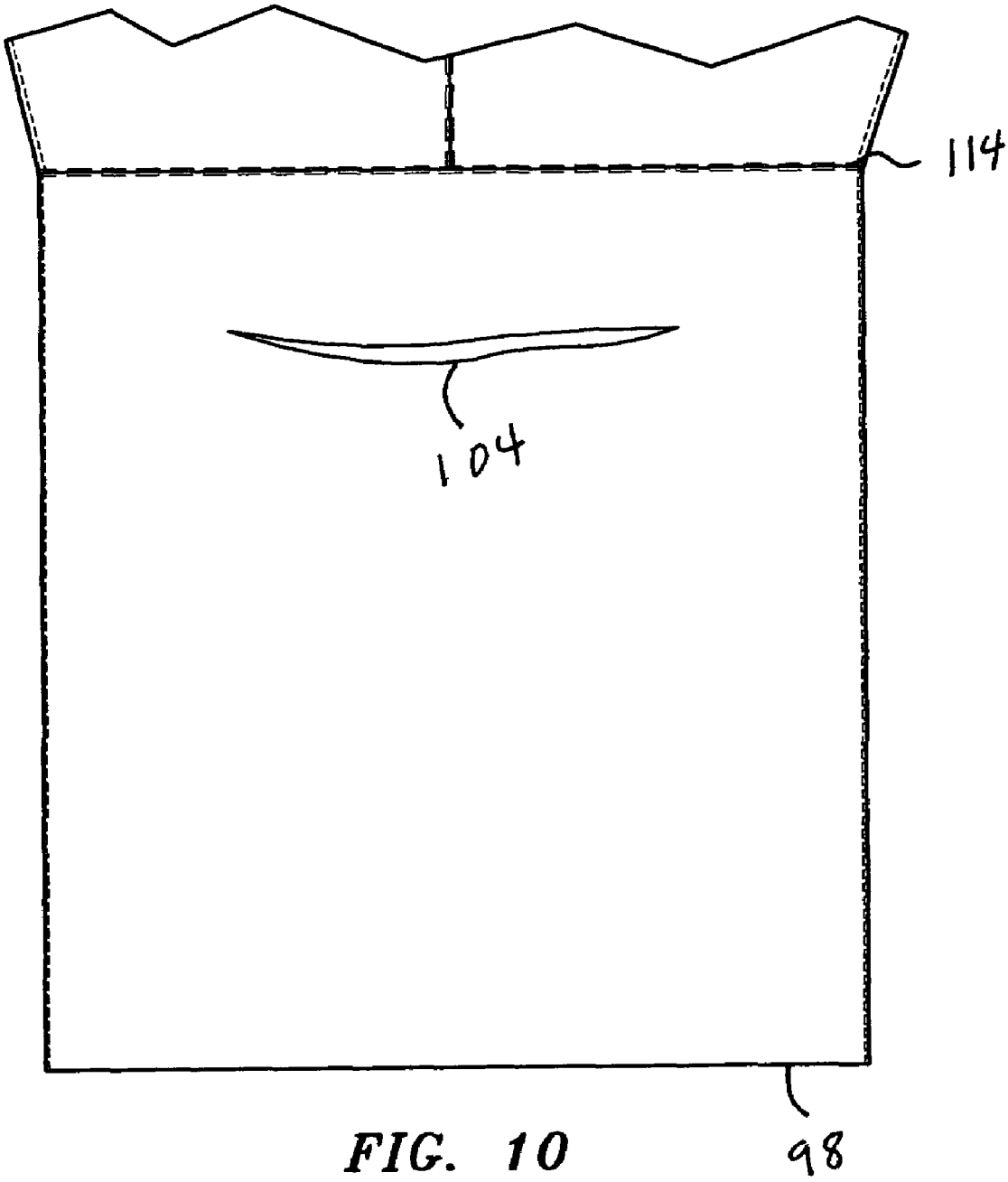
FIG. 10 is the pocket for drainage receptacles.
Figure 11:
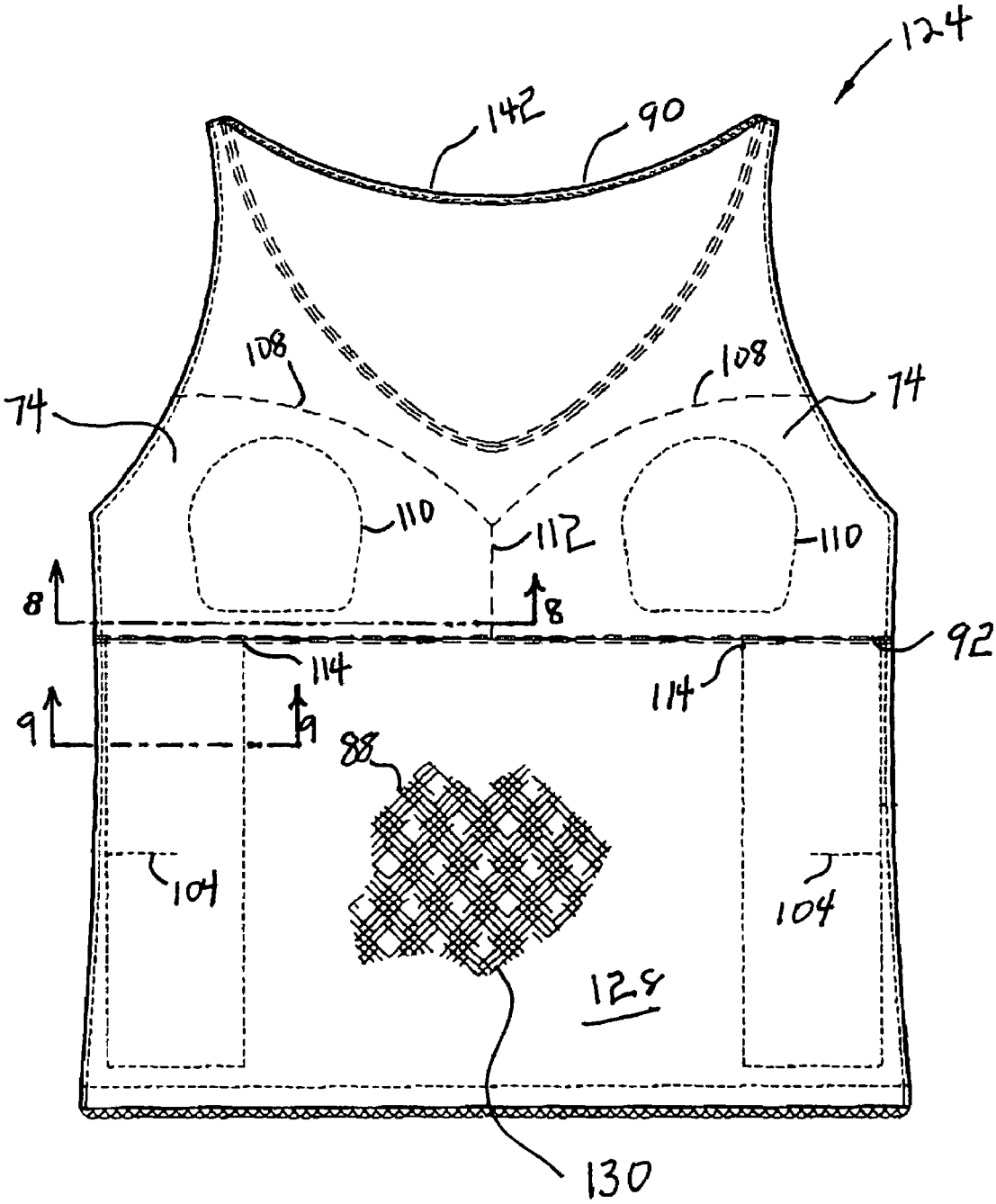
FIG. 11 is a rear view of the preferred embodiment.

The preferred embodiment is shown in FIGS. 7 to 13. With reference to FIGS. 7 and 11 there is shown a garment 124 having a first side or garment front panel 126 and a second side or garment rear panel 128. There is shown an outer or first layer 130 and an inside or second layer 132 with a bottom 134. The first layer 130 is an attractive outer layer such as a stretchable lace and the second layer is a stretchable lightweight liner. A yoke 136 connects and spans the first side 126 and second side 128 and provides a neck-receiving opening 138 which is low-cut or low 140 on the first side 126 and high-cut or raised 142 on the second side 128. The high-cut 142 is only slightly bowed downward and the low-cut 140 is substantially lower than the high-cut 142. This permits the garment to be reversed so that the raised part 142 will cover any surgical scars, if needed, in the front on the low side can be used, optionally, if there are no such scars. Thus, the garment can be reversed from front to back if desired.

Arm openings 144 are provided between the yoke 136 and the body of the garment 124. The garment has four soft cup pockets 146 and 74, which are attached, respectively, two to the second layer 132 of the first side and two to the second side. The bottom 134 of the second layer extends to or just above the bottom 106 of the garment. The soft cup pockets are attached to the inside along sew lines 108 at the horizontal midstream 92. The two soft cups on the first side and second side are separated by a vertical midseam 112 separating the two soft cup pockets. The arrangements for the soft cup pockets permit the garment to be reversed and either one or two or none of the soft cup pockets used. If the breast removal is only for one breast, the second is not used and the layer of flexible fabric for the pocket 73 or 75 would not interfere with its usage even if no soft cup is used. An outline of the location of soft cup 110 is shown in FIGS. 7 and 11, but it is not shown in FIG. 8.

Figure 12:
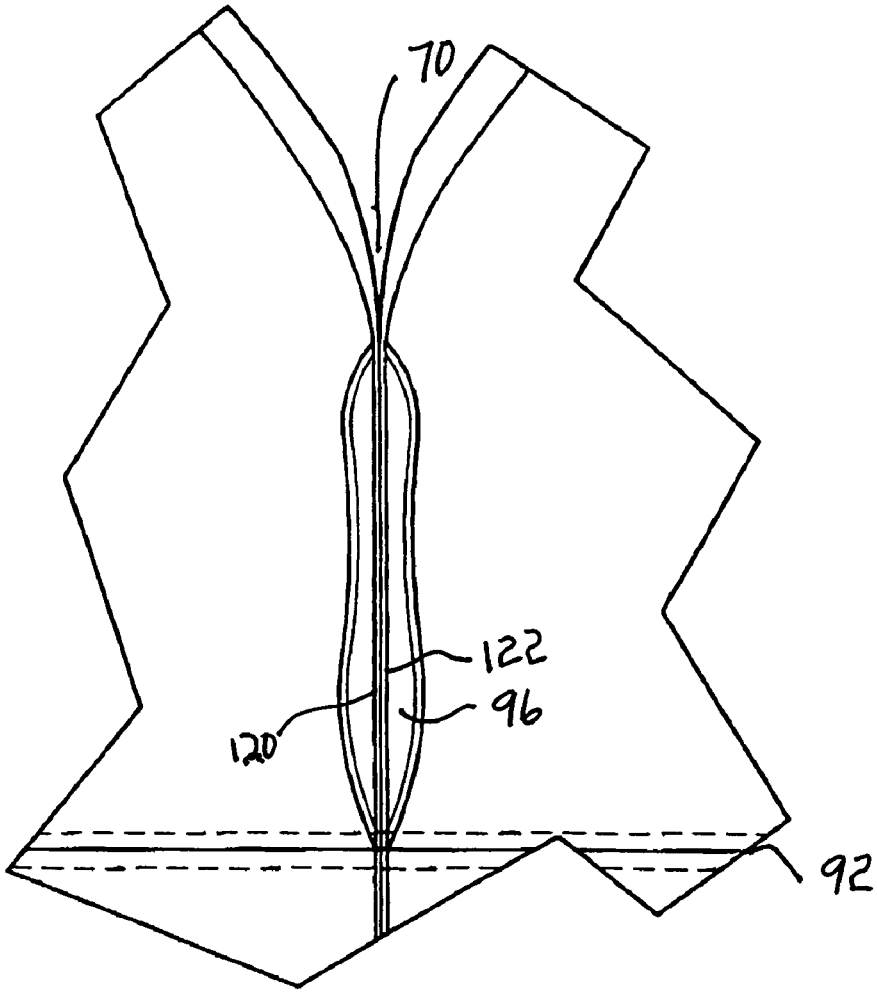
FIG. 12 is a partial sectional view of an opening for the pockets for the soft cups.
Figure 13:
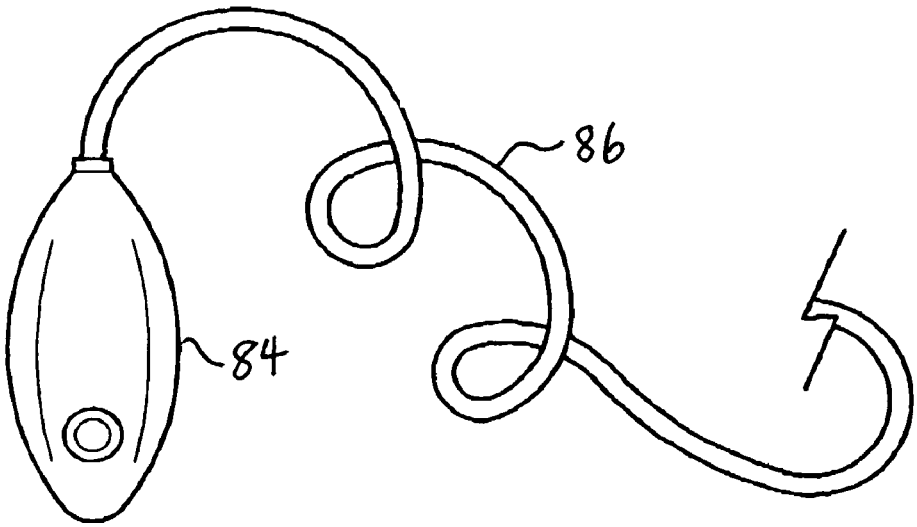
FIG. 13 is a partial view of a drainage receptacle and a length of tubing.

With reference to FIGS. 7, 11, and 12, there is shown how the garment 124 provides for the ease of insertion and removal of the soft cups to and from the soft cup pockets.

An access opening 94 is provided on a first end and an access opening 96 is provided on a second end. These openings are located on the two ends between the bottom of the arm openings 144 and the horizontal midseam 92 and are better seen from a partially opened access opening 96 in FIG. 12 and the partial sectional view of FIG. 8. The access opening 96 is spread open and the soft cup is either inserted or removed from the soft cup pockets by placing or removing them from between the inside layer 132 and the wall of the soft cup pocket layer 73 when the first side 126 is used or between 118 and 75 when the second side 128 is used. As shown in FIG. 7, looking to the left, the inside wall of the pocket 120 is shown fastened to the first side 126 and inside wall of pocket 122 is shown fastened to the second side 128.

With reference to FIGS. 7, 9, 10, 11, and 13, there is shown a stretchable mesh arrangement for handling drainage. A first drainage pocket 76 and a second drainage pocket 78 are shown suspended from being attached at the horizontal midseam 92 at the top 114 with one half of the drainage pocket on the first end 80 and second end 82 deployed towards the first side 126 and the remaining half deployed toward the second side 128. The drainage pockets are approximately 13 inches wide and 10½ inches tall with an opening approximately 6½ inches from the bottom 98 of the drainage pockets for the containers 84. Each drainage pocket can accommodate at least three containers 84 and a length of drainage tubing 86. The drainage pockets have a first wall 100 and a second wall 102 closer to the wearer with the opening 104 in the first wall 100 closer to the inside layer 132.

When in use, the containers are part of the tubing are carried by the drainage pocket. They can be at the rear when walking or shifted to the front or side when laying down. Several times a day, the container must be emptied into a measuring cup (not shown) and the amount recorded. The length of tubing facilitates moving the container from the pocket to the measuring cup and the container and tubing are then placed back into the pocket until the next emptying time arrives. The other end of the tubing (not shown) is attached to the patient and not removed until the patient is sufficiently well.

The first embodiment, shown in FIGS. 1 to 6, is a pretty camisole with a feminine fit but with pockets for usually one to six drains, which are normally unwieldy. The drains are placed by the surgeon in the patient during the mastectomy. The undergarment has a relatively flat front vertical closure held together by releasable fastenings such as flat snaps, buttons, or the like. When open, the garment eases the dressing and undressing following the surgery. The undergarment also has soft, molded cups on the inside of the garment. The surgeon allows no underwire, elastic, bindings or other similar restriction in contact with the breast during this transitional period. The use of the soft, molded cups provide a measure of modesty for the patient and permits her to feel more feminine and to appear somewhat "normal" on the outside after the traumatic surgery. The tender weeks after returning home from the hospital with a mastectomy and the greeting of visitors while still in the hospital before returning home is the beginning of a return to normalcy. The use of the undergarment permits the woman to wear the undergarment under her factorite blouse or dress and makes her feel more comfortable and less self-conscious.

The use of the garment permits every woman, after a mastectomy, to "look good", and can help a woman during the transitional period after surgery in a practical, emotional, and spiritual way during this very difficult and traumatic time when her femininity has been attacked to the very core.

Figure 2:
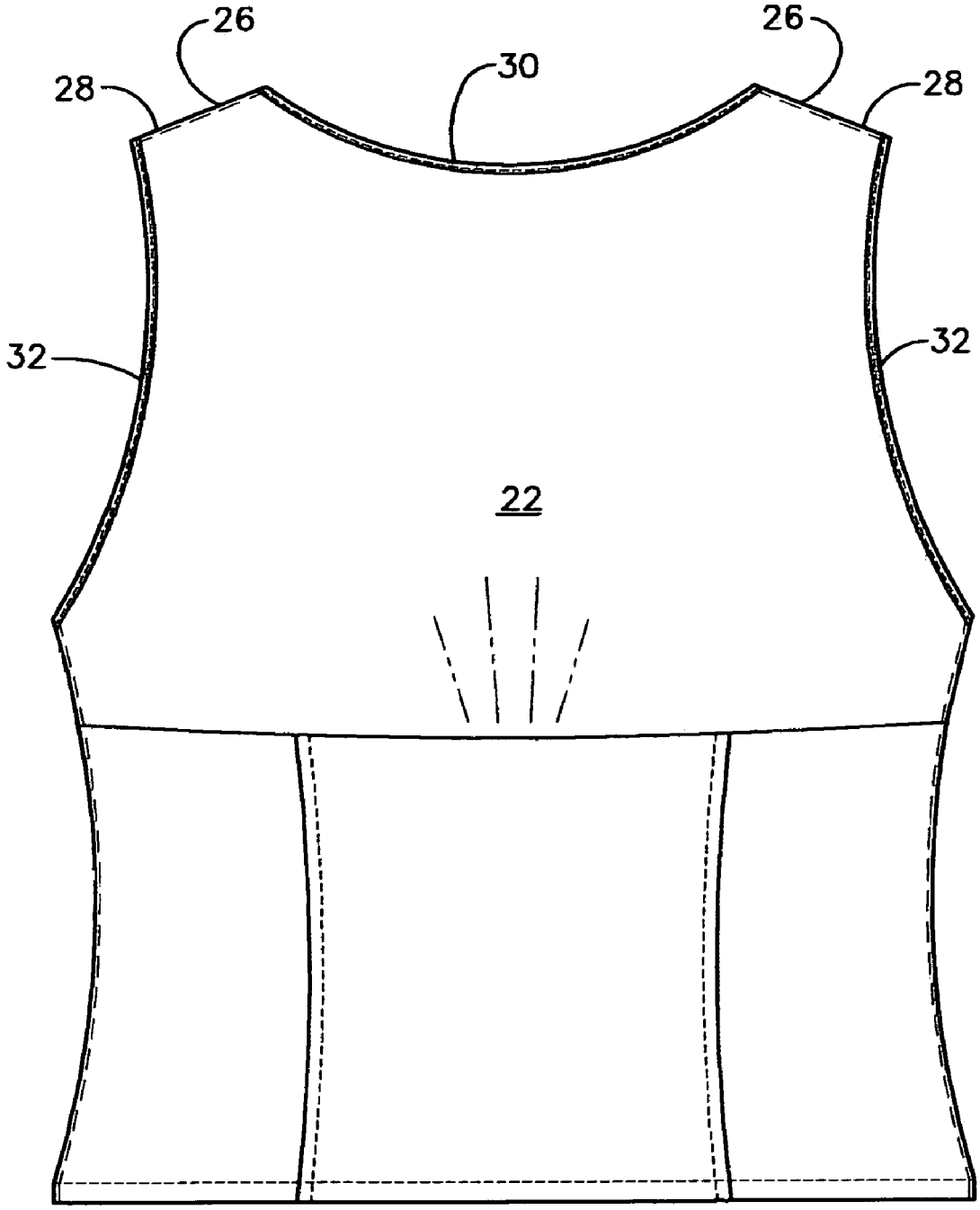
FIG. 2 is a rear view of the garment.
Figure 3:
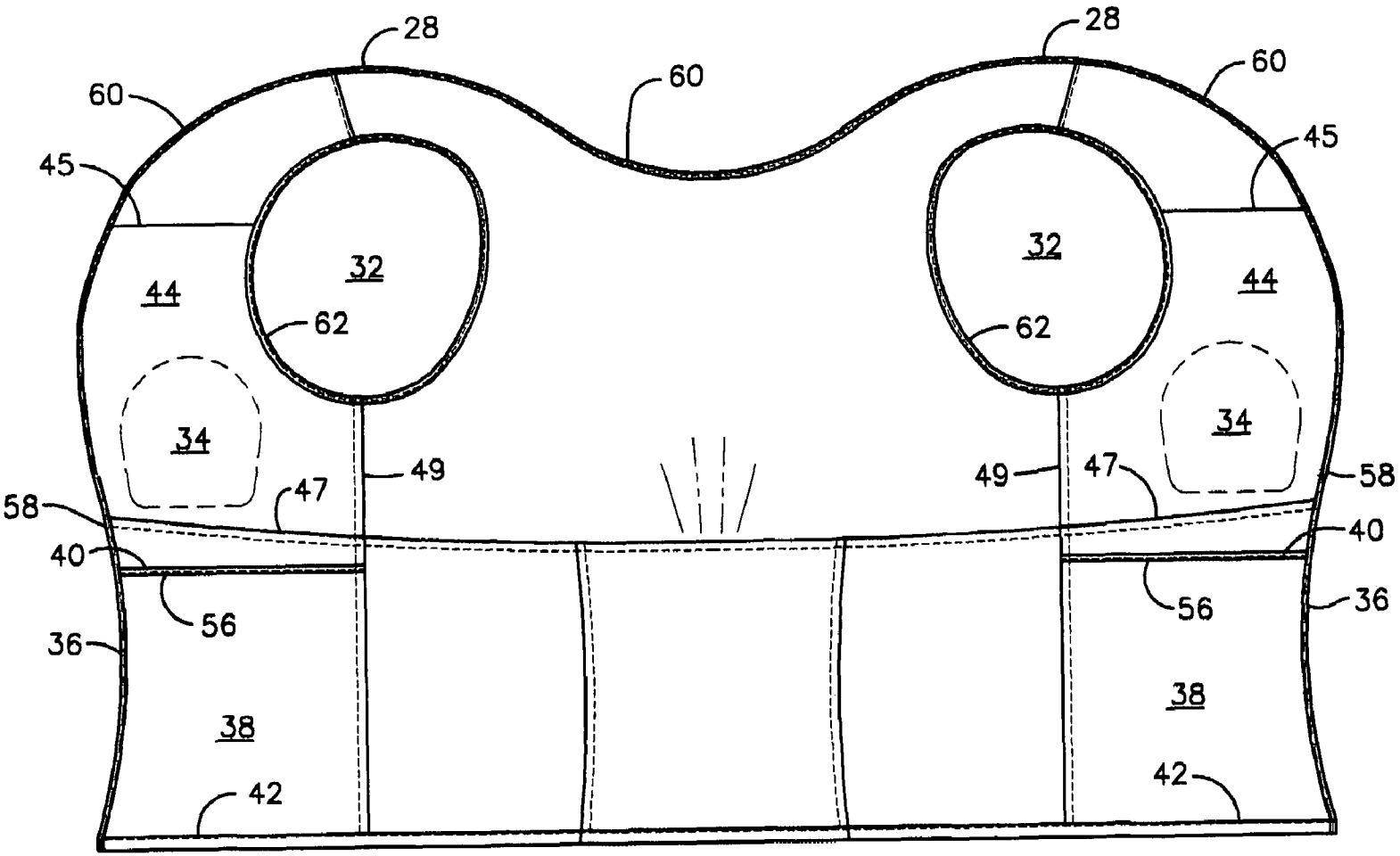
FIG. 3 is a schematic front view of FIG. 1 with the garment opened.

With reference to FIGS. 1 to 3 there is shown the undergarment 10 of the present invention having a front section 12 made of a stretchable fabric 14 with a front lower edge. The front section 12 of the closed undergarment as shown in FIG. 1 has a left front section 18 and a right front section 20.

As used in this disclosure, the undergarment is usually referred to the closed undergarment with the wearer looking forward.

A shown in FIG. 2, there is shown the rear section 22 having a rear lower edge 24 and shoulder engaging yoke 26. The front section or garment front panel 12 and the rear section or garment rear panel 22 are connected together at two connectors 28. The connectors 28 may be part of the fabric 14 itself and preferably between one inch and seven inches in width.

FIGS 1 and 2 show the neck receiving opening 30, which is formed when the undergarment is closed.

The garment 10 has two sleeveless openings 32 which are best shown in FIG. 3. As shown schematically in dotted lines, the undergarment 10 has two soft cups 34. The soft cups 34 are wireless and non-binding and are readily available as soft molded cups usually having a fabric covering both sides of a core. The soft cups 34 are generally molded and give the semblance of the presence of a breast underneath and help fill out the garment of the user.

The undergarment 10 has a front closure 36 which, when opened, more readily lets the user slip in and out of the undergarment, even though it may be carrying one or more drainage vessels or receptacles, which are housed in two drainage pockets 38, one on the left side and one on the right side of the front of the undergarment. It is important to note that these pockets are on the inside and are less noticeable when a garment is used on the outside of the undergarment. Each of the drainage pockets 38 has a left side, a right side, and a bottom side sewn to the inside of the undergarment 10. The top is open, as shown in FIG. 3, where the top opening 40 permits the drainage receptacle to be placed in and removed from these drainage pockets 38. The bottom edge 42 of the drainage pockets 38 is preferably located adjacent the front lower edge 16 but may be placed slightly above the front lower edge 16 if the undergarment 10 is slightly longer than that shown in FIG. 3. The undergarment is generally of a length extending to the waistline or a small distance below the bellybutton. Each drainage pocket 38 can preferably accommodate up to three drainage receptacles, as a mastectomy patient may have from one to six drainage receptacles and occasionally more after the operation.

Figure 4:
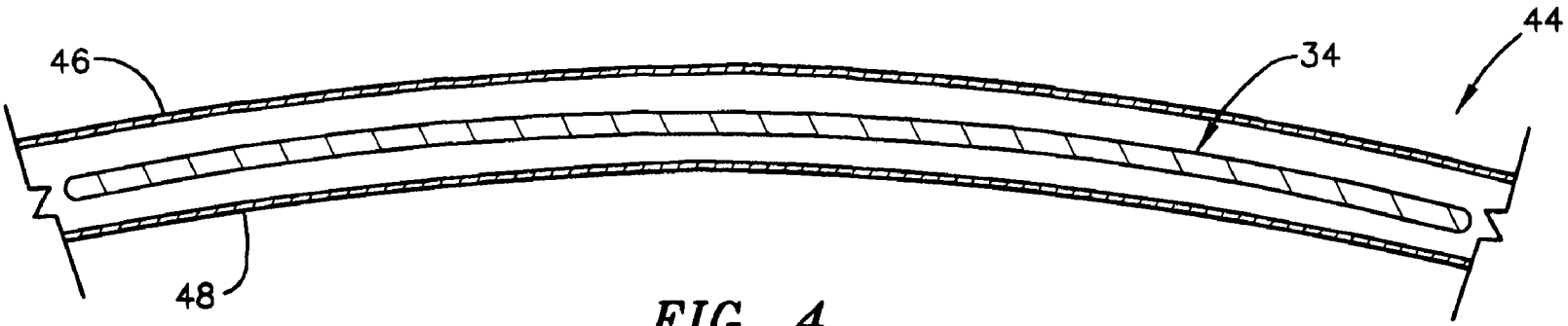
FIG. 4 shows a partial sectional view 4-4 through the soft pads and pocket.

As best seen in FIGS. 3 and 4, a soft cup pocket 44 is placed on the inside of the undergarment 10. The soft cup pocket 44 has an open top 45, a closed bottom 47, and extends between seam 49, the elastic edge 58, and around part of the elastic edge 62. The outside surface 46 is preferably the fabric itself and forms one side of the soft cup pocket 44. The other side of the soft cup pocket 44 has an inside surface 48 with the soft cup pocket 44 being between the two surfaces 46, 48. The soft cup 34 is placed within the soft cup pocket 44 and kept in place by the soft cup pocket 44. An alternative, not shown, is that the soft molded cup 34 can be fastened to the inside of the undergarment 10 at the same general location without a pocket.

It is to be noted that the entire garment should be feminine styled and not just a hanging member such as a smock. The garment of the first embodiment of FIGS. 1 to 6 is designed to be used underneath an outer garment, although in some instances an outer garment may not be utilized. In order to emphasize the feminine styling as shown in FIG. 1, there are two concave sides 50 that are necked in approximately at the waistline of the undergarment. Likewise the concave sleeveless openings 52 provide for additional styling and the concave neck opening 54 also provides for such styling.

Much of the garment elastic edges, which are sewn to the edges using standard elastic tape or other elastic member. Such elastic material is readily available and is distinguished from the flexible material that is preferred for the fabric 14 of the undergarment 10 which has some stretch but not nearly as much stretch as the elastic bands or edging. An elastic edge 56 is used at the top opening 40 of the pockets for drainage receptacles 38. An elastic edge 58 is also used on each side of the closure 36 and extends to an elastic edge 60, which circles the neck receiving opening 30. The elastic edge 60 is on the rear neck portion and extends to the V-shaped front neck portion. An elastic edge 62 surrounds the entire sleeveless opening 32. The front closure 36 preferably has elastic edges 58 down both sides and these elastic edges 58 meld together with the elastic edge 60 of the neck receiving opening 30 so that in a preferred embodiment an elastic edge goes from the bottom of one side of the garment all the way around to the other side of the garment when it is opened as shown in FIG. 3.

Figure 5:
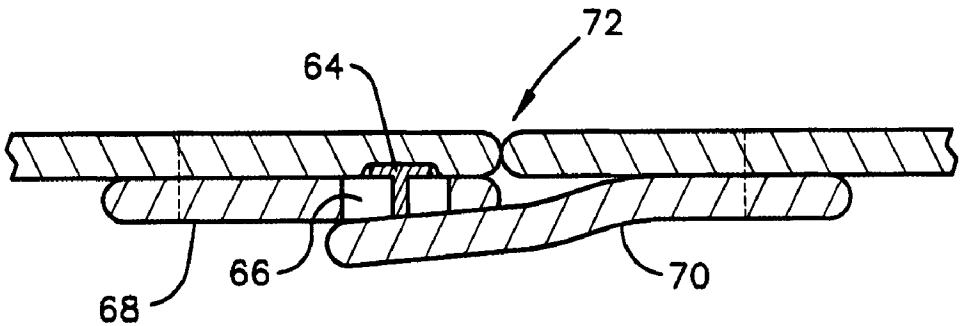
FIG. 5 shows a partial sectional view 5-5 through the front closure.

With reference to FIG. 5, there is shown schematically a preferred type of closure where a row of buttons 64 are fastened through button holes 66. The holes 66 are in flap 68 sewn to the inside of the outer wall of the undergarment 10 and the buttons 66 are carried by the flap 70 on the right side that is sewn to the inside surface of the other side of the closure. The resulting closure has a flat exterior 72, which improves its appearance. Other types of closure elements may be utilized, such as flat snap buttons and Velcro®, a separable fastener available from Velcro Industries B.V. Corporation. The elastic edge, for purposes of simplicity, is not shown in FIG. 5.

Figure 6:
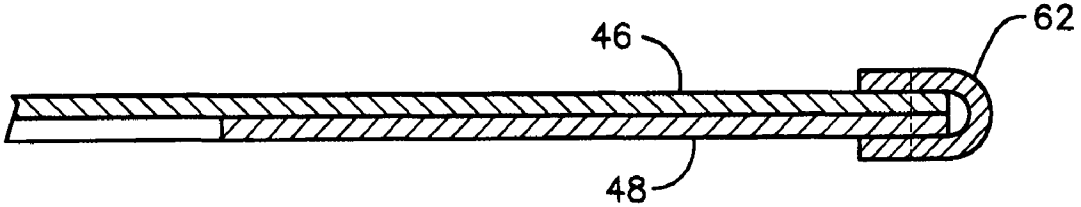
FIG. 6 shows a partial sectional view 6-6 through the concave sleeveless openings showing the edge and top of the soft cup pocket.

With reference to FIG. 6, there is shown a partial cross-section 6-6 of FIG. 1 where schematically shown is the pocket outside surface 46, pocket inside surface 48, and the elastic edge 62. This shows one of many ways to have an elastic edge 62 at the edge of the undergarment. Similar edging can be used in the other places where an elastic edge is preferred.

There is disclosed an garment that is feminine styled to serve as a transitional piece of clothing for use by mastectomy patients immediately following surgery. It is to be noted that there are many changes that may be made that would be obvious to a person of skill in the art.

What is claimed is:

1. A front and rear reversible attractive feminine styled transitional garment for use by mastectomy patients immediately following surgery comprising:

a garment front panel and garment rear panel;

said garment front panel and said garment rear panel each having an outer layer of an attractive stretchable lightweight fabric and an inside layer of a stretchable lightweight liner;

a shoulder engaging yoke connecting said garment front panel and said garment rear panel;

a neck-receiving opening within said yoke, said neck-receiving opening including a low neckline on said garment front panel and a high neckline on said garment rear panel allowing said garment to be reversed so that said garment front panel with said low neckline is repositioned to the rear of the wearer and said rear with said high neckline is repositioned to the front side of the wearer;

openings for arms between said yoke and said garment front panel and said garment rear panel;

two wireless and non-binding pockets for soft cups made of stretchable material carried on the inside of said inside layer of said garment front panel;

two wireless and non-binding pockets for soft cups made of stretchable material carried on the inside of said inside layer of said garment rear panel;

a first and second drainage pocket of stretchable mesh carried on the inside of said inside layer of said garment front panel and on the inside of said inside layer of said garment rear panel at a first end and a second end of said garment; and said first and second drainage pockets adapted to carry more than one drainage container together with a length of tubing to permit dumping said drainage containers into a measuring cup without said containers being detached from the tubing.

2. The garment of claim 1 wherein said outer layer of lightweight fabric is lace with a stretchable lace edging.

3. The garment of claim 1 wherein said inside layer of said garment front panel and said garment rear panel each has a generally horizontal midseam.

4. The garment of claim 1 wherein said soft cup pockets have access openings on said first end and said second end between said openings for said arms and said midseam of said inside layers.

5. The garment of claim 1 wherein said mesh drainage pockets have a bottom, a first wall, and a second wall;

said second wall facing said inside layer; and said mesh drainage pockets being approximately 10½ inches tall and 13 inches wide with an opening located approximately 6½ inches above said bottom on said second wall.

* * * * *